US006098699A

United States Patent [19]

Junius

[11] Patent Number: 6,098,699

[45] Date of Patent: Aug. 8, 2000

[54] EASY CURTAIN

[75] Inventor: Samantha Marie Junius, Marrero, La.

[73] Assignee: Samantha M. Junius, New Orleans, La.

[21] Appl. No.: 09/336,923

[22] Filed: Jun. 21, 1999

[51] Int. Cl.[7] ..... A47H 1/00

[52] U.S. Cl. ..... 160/330; 160/345; 160/368.1; 160/DIG. 6; 16/87.2

[58] Field of Search ..... 160/84.1, 123, 160/126, 330, 345, 368.1, 349, DIG. 6; 16/87.2; 24/442; 4/610; 211/105.1

[56] References Cited

U.S. PATENT DOCUMENTS

| | | | |
|---|---|---|---|
| 4,088,174 | 5/1978 | Edwards | 160/349 R |
| 4,769,862 | 9/1988 | Skrzelowski | 4/610 |
| 5,109,912 | 5/1992 | Gary | 160/330 |
| 5,148,580 | 9/1992 | Dyckow | 24/303 |
| 5,421,059 | 6/1995 | Leffers, Jr. | 160/330 X |
| 5,421,393 | 6/1995 | Wolfe | 160/349.1 |
| 5,426,821 | 6/1995 | Story | 16/87.4 |
| 5,555,603 | 9/1996 | Chester | 16/87.2 |
| 5,561,870 | 10/1996 | Hertel | 4/609 |
| 5,586,595 | 12/1996 | Takizawa et al. | 160/330 |
| 5,615,461 | 4/1997 | Tominaga et al. | 24/452 |
| 5,662,297 | 9/1997 | Christensen et al. | 211/105.1 |
| 5,787,954 | 8/1998 | Herrera | 160/330 |
| 5,791,013 | 8/1998 | Lin | 16/87.2 |
| 5,806,141 | 9/1998 | Kolisch | 16/87.2 |
| 5,894,642 | 4/1999 | Eberhardt | 24/716 |

*Primary Examiner*—Bruce A. Lev

[57] ABSTRACT

The assembly relates to a way of hanging and removing a shower curtain. The curtain eliminates the tedious job of attaching the curtain holders, then taking them off one at a time to remove the curtain when it is time to wash or replace. Bead attachment members can be placed on the curtain and left even during washing. They can be changed to different colors or styles for decorative purposes. The bead attachment members replace the standard ring connectors. They can be manually attached or can be fixed on the curtain. The specially designed shower curtain rod receives the bead attachment members with ease. The telescoping rod is then placed in the U-shaped socket rod holders for easy assembly and disassembly.

4 Claims, 8 Drawing Sheets

EASY CURTAIN

BACKGROUND OF THE INVENTION

1. Field of the Invention

The present invention relates to the hanging of the standard shower curtain using a unique attachment device. The bead attachment device, which comes in different styles makes it easy to hang the shower curtain and take it down. The specially designed telescoping rod is made just for receiving the bead attachment devices with ease. Here is a list of researched patents that related to a shower curtain or drapery that will be discussed.

2. Description of the Related Art

Individuals faced with the household task of hanging, replacing and removing the shower curtain must deal with a frustrating and tedious chore. There is a need to make this job fun, easy and turn the simple hanging of a shower curtain into a neat decorating activity. Once the bead attachment devices are on the curtain, they need not come off and are water proof. The most common way of hanging the shower curtain is by using the ring connectors. The rings are placed on the curtain one at a time and then placed on the curtain rod one at a time. When it is time to clean or remove the curtain, the ring connectors again must be opened one at a time. This task is not only time consuming, but tiring because of the awkward position to perform the job. Also the apertures on a standard curtain or liner tear very easily when inadvertent stress is placed on the curtain. The bead attachment devices with its stretchable ring eliminates these problems.

U.S. Pat. No. 5,421,393 issued on Jun. 6, 1995 to M. Wolfe describes a shower curtain edge stay to prevent a shower curtain from curling inward. A stiffening rib member is disposed at the bottom of and on at least one side of a shower curtain. The stiffening rib member is at the edge of the shower curtain and extending parallel to a horizontal edge of the shower curtain. The Easy Curtain is for a totally different use from Wolfe's invention.

U.S. Pat. No. 5,109,912 issued on May 5, 1992 to L. Gary is a drapery system with a standard C-shaped drapery rack which holds a drapery carrier having a spool-shaped head portion supporting a flat plate portion having hook material on one side and loop material on the other side. These fastening aids will attach to hook or loop patches on the top rear edge of the drapery. This hanging method for drapery is useful, but Easy Curtain is usually concerned with the hanging of shower curtains or liners. Drapery could be hung using the Easy Curtain method if the drape could accept the bead attachment devices.

U.S. Pat. No. 5,148,580 issued on Sep. 22, 1992 to D. W. Dyckow describes a shower curtain sealing and fastening arrangement kit. A strip of hook or loop material is attached to one side edge of a shower curtain to mate with another strip of loop or hook material on the shower stall wall. A sealing protrusion strip is also provided to apparently clamp the edge of the shower curtain.

U.S. Pat. No. 5,615,461 issued on Apr. 1, 1997 to Y. Tominaga et al. describes a hanging device for a pleated curtain having separated patches of female or looped fasteners on its top rear edge which mate with a plurality of curtain hanging fasteners. A fastener comprises a rectangular plate-like base member with a top hook. The base member has a critical arrangement on one face of male or hook fasteners which are molded with the plastic base. The hooks are formed in three groups with the hooks directed either downward or toward to resist disengagement. The hanging device is hooked onto a curtain runner with rollers traversing a C-section curtain rail.

U.S. Pat. No. 5,586,595 issued on Dec. 24, 1996 to T. Takizawa et al. describes a curtain attachment connector comprising a fastener member similar to Tominaga et al. except for the arrangement of the hook elements arranged in rows, columns or in scattered array with the hook ends up.

U.S. Pat. No. 5,662,297 issued on Sep. 2, 1997 to Christensen, et al. describes an adjustable shower curtain rod. The shower curtain support rod assembly which mounts between opposing bathtub stall walls which, when installed, allows a shower curtain to be slidably movable in an inward and outward direction with respect to the longitudinal edge of the bathtub, thereby creating more space for a shower taker. When a shower is not in progress, the shower curtain can be slid inward thereby creating more space in the remaining bathroom area.

U.S. Pat. No. 5,561,870 issued on Oct. 8, 1996 to Hertel presented here is a shower curtain rod attachment. A one-piece, multi-functional gripping connector is disclosed, to be used as a shower curtain rod attachment in conjunction with a standard shower curtain and curtain rod assembly, to allow the end or ends of the curtain to be turned inward, thereby preventing water from spraying out of the shower enclosure. The sole point of support for the attachment is its connection to the shower curtain rod. The invention is comprised of a single sheet of strong, flexible, elastic material, such as PETG thermoplastic, which is formed into an open-sided, open-ended, tubular shape having rounded edges, and which is also notched and bent 90-degrees at the mid-point to form an elbow configuration. Installation is by hand, without use of tools, and will not damage existing surfaces. Removal of the shower curtain rod is not required. Alternate embodiments are also disclosed, which provide illustrations of the invention's multi-functional aspects.

U.S. Pat. No. 5,426,821 issued on Jan. 27, 1995 to Story describes a wrap-around bathtub curtain rod The shower curtain rod has curved ends branching from the straight body. A curtain hung therefrom is caused to follow a curved contour of a bathtub below. Tracks are provided on the inner and outer sides of the curtain rod so that inner and outer curtains may be suspended therefrom. The inner curtain follows the bathtub contour, and the outer curtain extends to both of two parallel walls defining the shower stall. Curtain fasteners are slidably held within the tracks. The fasteners are insertable when turned ninety degrees from their normal, vertical orientation, then turned so that fastener hooks face downwardly. The fasteners are thus positively retained by the curtain rod, while allowing the curtains to be opened and closed independently from one another.

U.S. Pat. No. 4,769,862 issued on Sep. 13, 1988 Skrzelowski describes a type of Shower curtain support. The shower curtain support defines a track for slidably suspending a shower curtain across the front opening of a shower stall and around end comers of the support rearwardly at the front opening. End portions of the shower curtain may be drawn around the comers and inside the shower stall to overlap at least a portion of the surface of the stall end walls in order to prevent leaks. Alternately, a continuous curtain support track is provided in a U-shape or other configuration. Endpieces attached thereto support a curtain in a plane parallel to wall surfaces to prevent spraying or splashing outside the shower area.

U.S. Pat. No. 4,088,174 issued on May 9, 1978 to Edwards describes a shower curtain anchor attachment. An apparatus to retain and guide the lower edge of a conventional shower curtain in relation to the inner surface of a shower or bathtub enclosure is mainly used to prevent water from spraying on the floor.

While many of the inventions dealt with the hanging of a curtain, none demonstrated the unique method of dealing with the problems of both hanging and removing the shower curtain in the same manner as the Easy Curtain.

BRIEF SUMMARY OF THE INVENTION

The Easy Curtain is an easier and more convenient way of removing and replacing the shower curtain/liner. The telescoping hollow rod has a track that faces the floor. The hollow opening of the rod is C-shaped to accept the bead attachment devices. The rod is attached to the wall by using U-shaped socket rod holders. These rod holders are suctioned, taped using an adhesive material or screwed to the wall. The rod is adjustable by a telescoping method. The bead attachment devices are attached to the apertures of the standard shower curtain/liner. Once the bead attachment devices are attached, there is no need to remove them. Now the curtain can be attached to the rod. Each bead can be fed into the opening of the rod. Once the beads are in the rod, the rod can now be replaced in the U-shaped holders. Now for the rod with the circular cut-out near the beginning of the track, the beads can be fed through that area and there will be no need to take the rod down once installed. The curtain/liner can be hanged or removed while this rod remains in place.

Since the beads do not have to be removed once they are attached to the curtain/liner, removing the curtain/liner means that the entire item can go into the washer. The bead attachment devices are water proof The rod is placed back in the U-shaped socket rod holders until the curtain/liner is cleaned. Once cleaned the curtain can be replaced on the rod with convenient and ease.

The advantages of this invention is an improved method of putting up and taking down the shower curtain/liner. The bead attachment devices are attached and need not be removed. The bead attachments become one with the curtain/liner. The specially designed rod and bead attachments will stop the frustration when having to do this job. It is a frustrating job to have to put up a shower curtain. Then when it is time to remove them the desire not to do this job causes a delay.

Problems with the shower curtain has been approached, but most of the prior art patents mentioned earlier are concerned with water spraying out of the tub or shower that may destroy the floors and walls. The other patents mentioned deal with more ways to prevent water spray, or hanging a curtain and liner together for ease to connect and disconnect with ease. There were even patents to handle hanging drapery curtains, but the problem that the Easy Curtain system solves continues to show that there is a great need for an easier was of hanging and removing the shower curtain/liner. The main problem that the Easy Curtain solves is eliminating the tedious job of placing each ring on to a curtain and then placing each ring around the rod. When it is time to take down the curtain, this aggravating job of unhooking each ring to take down the curtain is discouraging.

Before showers were invented there was no need for a curtain except maybe for privacy. With the advent of the shower, there was now a need to prevent water from splashing or spraying on the walls and floor. One solution is to nail the curtains to the walls. The rods that are used have some type of pluralities that must be attached to the curtain and then attached on the rod. Some rods even have a track system in which some type of device slides back and forth. These sliding devices are there to attach the curtain. For each of these systems the curtain is attached by devices that must be put on and taken off the curtain each time the curtain must come down or the curtain must be attached to each hook or clamped device one at a time. This is time consuming and tedious, but the Easy Curtain solves these problems.

OBJECTS OF THE INVENTION

Here is a list of the different objects:

1. adjustable rod with C-shaped track along the length of the rod.
2. U-shaped socket rod holders.
3. adjustable rod with C-shaped track with a circular opening near the beginning of the track at the base of the rod.
4. Standard Shower curtain or liner
5. Bead attachment with stretchable ring part
6. Cosmetic Cover
7. Bead attachment with pull-back spring-open clamp
8. Stretchable ring
9. Rod clamp for rod with circular opening near the beginning of the track at the base of the rod
10. Bead attachment device with squeeze open clamp.
11. Straight opening at the base of the rod
12. Opening at the base of the rod with the circular opening near the beginning of the track at the base of the rod
13. Circle opening to slide bead attachment into place
14. Optional points for screws on the U-shaped socket rod holders
15. Point where the rod adjusts on the rod with the plain C-shaped track
16. Point where the rod adjusts on the rod with the circular opening near the beginning of the track.

DETAILED DESCRIPTION OF THE DRAWINGS

Figure 1:
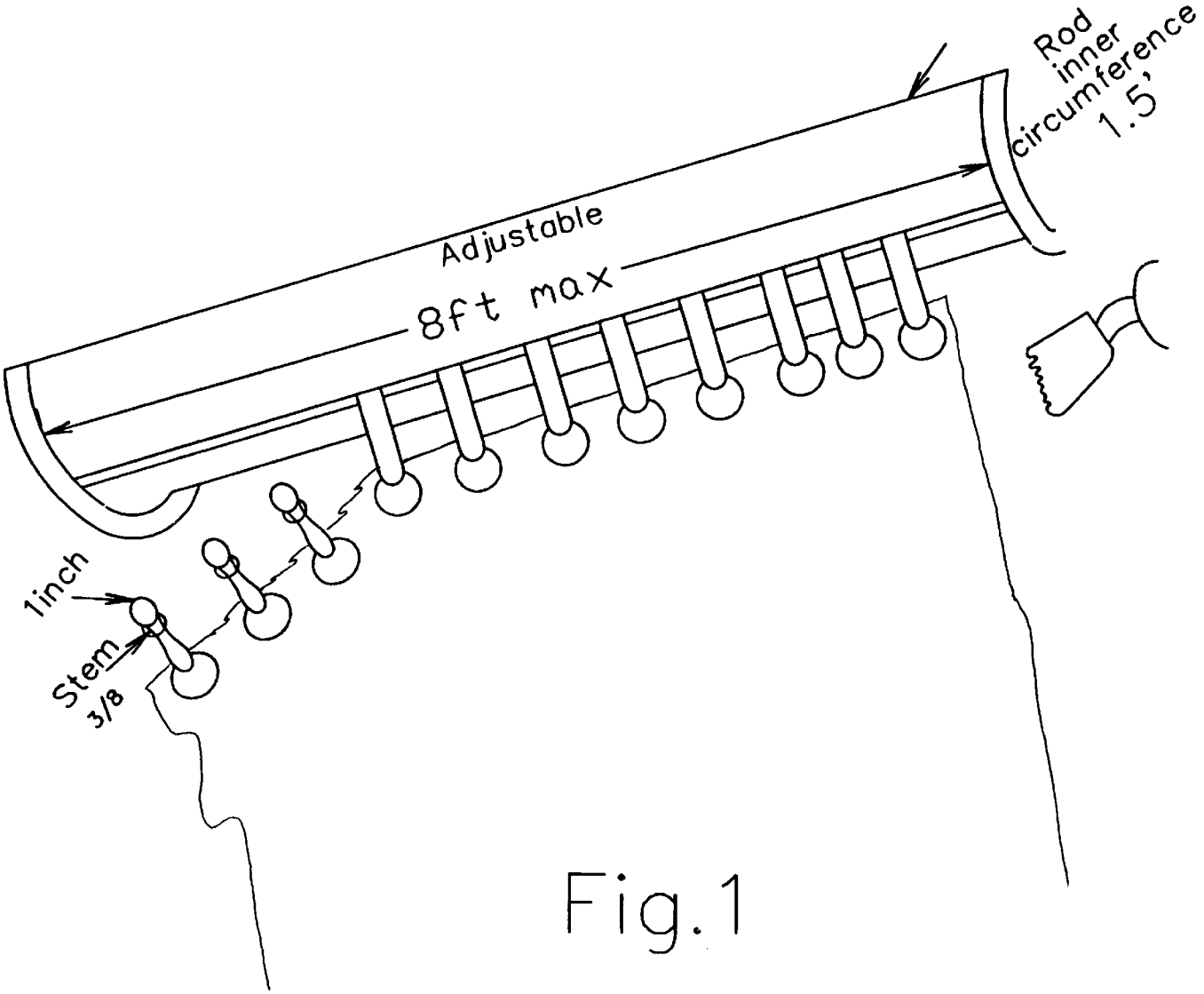
FIG. 1. is a front angled view of the easy curtain system.

In FIG. 1 the adjustable rod with the straight track at the base, 1, is mounted on the wall. The straight track is depicted as number I1. The U-shaped socket rod holders, 2, is where the rod is resting in place. The U-shaped socket rod holders can be held in place by screws or some type of adhesive material. The telescoping capability of the rod is indicated by number 15. Because shower stalls are different sizes, this is necessary.

In FIG. 1 the shower curtain or liner, 4 is standard curtain or liner. Here number 4 is attached to the rod with the new bead attachment devices, number 5. The ring attachment, not shown here, which is looped on to the curtain is not as pleasing to the eye. The cosmetic cover, 6 hides the looped ring. Once the bead attachment is in place, it never has to come off. Now the task of removing the curtain one connector at a time for each time the curtain or liner must come down is eliminated. The reverse is now true for replacing the curtain or liner after just washing. It can easily be re-hung. Another wonderful feature of the Easy Curtain System is that another standard curtain or liner can still be hung using the traditional "question-mark" shaped hooks. These hooks can hang like usual over the top of the rod and not interfere with the moving of the liner or curtain using the track at the base of the rod.

Not only are there different styles of the rod from different colors to clear, but there can be different shapes. The utility of the invention remains the same. Also there are different styles of the bead attachment and there can be different colors. The cosmetic cover can also be different colors to match or complement the bathroom or other bath accessories.

Figure 2:
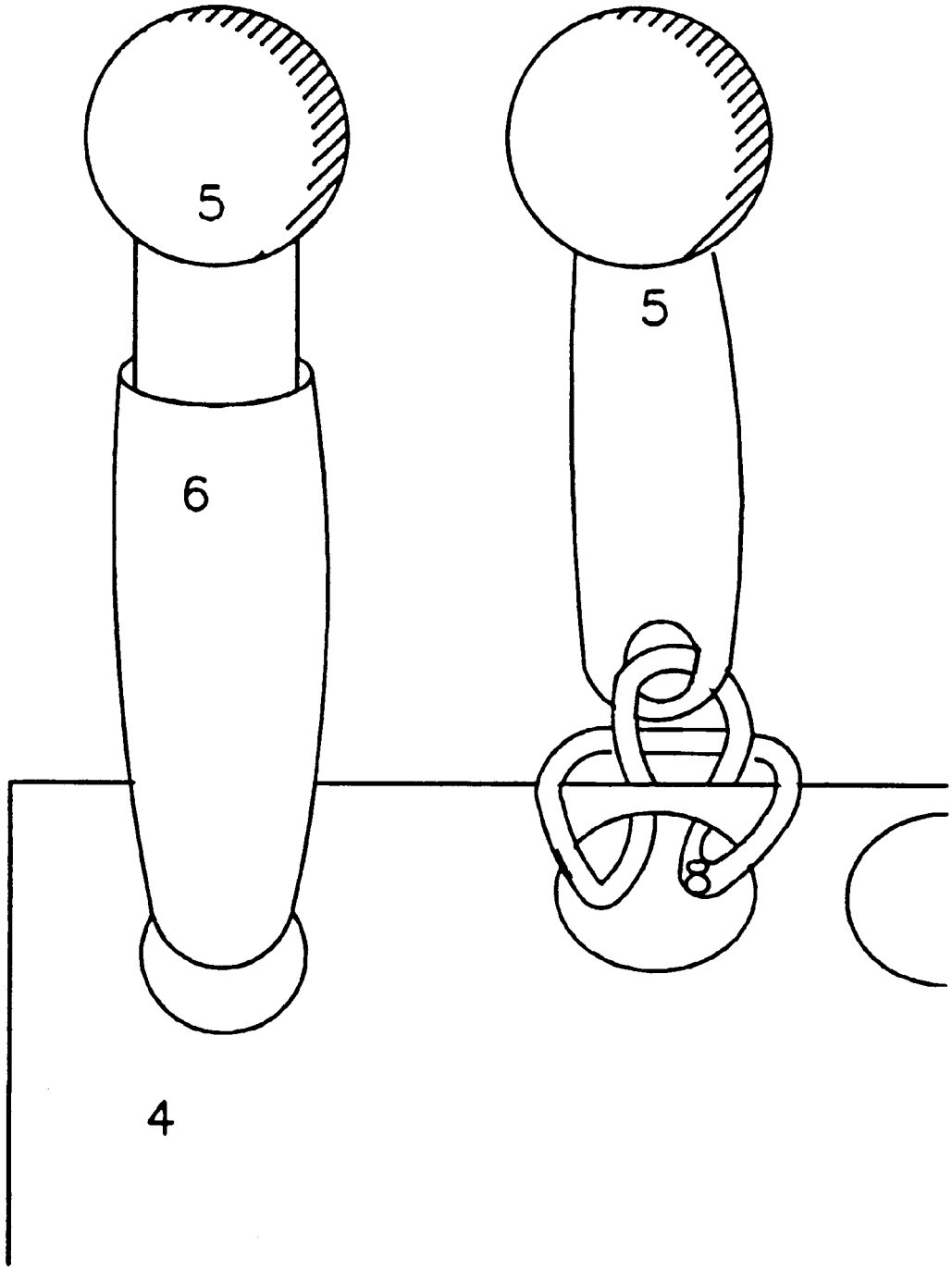
FIG. 2. is a front view of one type of bead attachment device attached on a standard curtain or liner. one had the cosmetic cover.

In FIG. 2 the exploded view of the bead attachment device with and without the cosmetic cover is connected to the standard shower curtain or liner, 4. The stretchable ring 8, which is permanently on the bead device, it looped on to the curtain or liner. The cosmetic cover, 6 is optional, but is more pleasing to the eye. The cosmetic cover must be slipped over the bead attachment device before the whole thing is attached to the curtain or liner.

Figure 3:
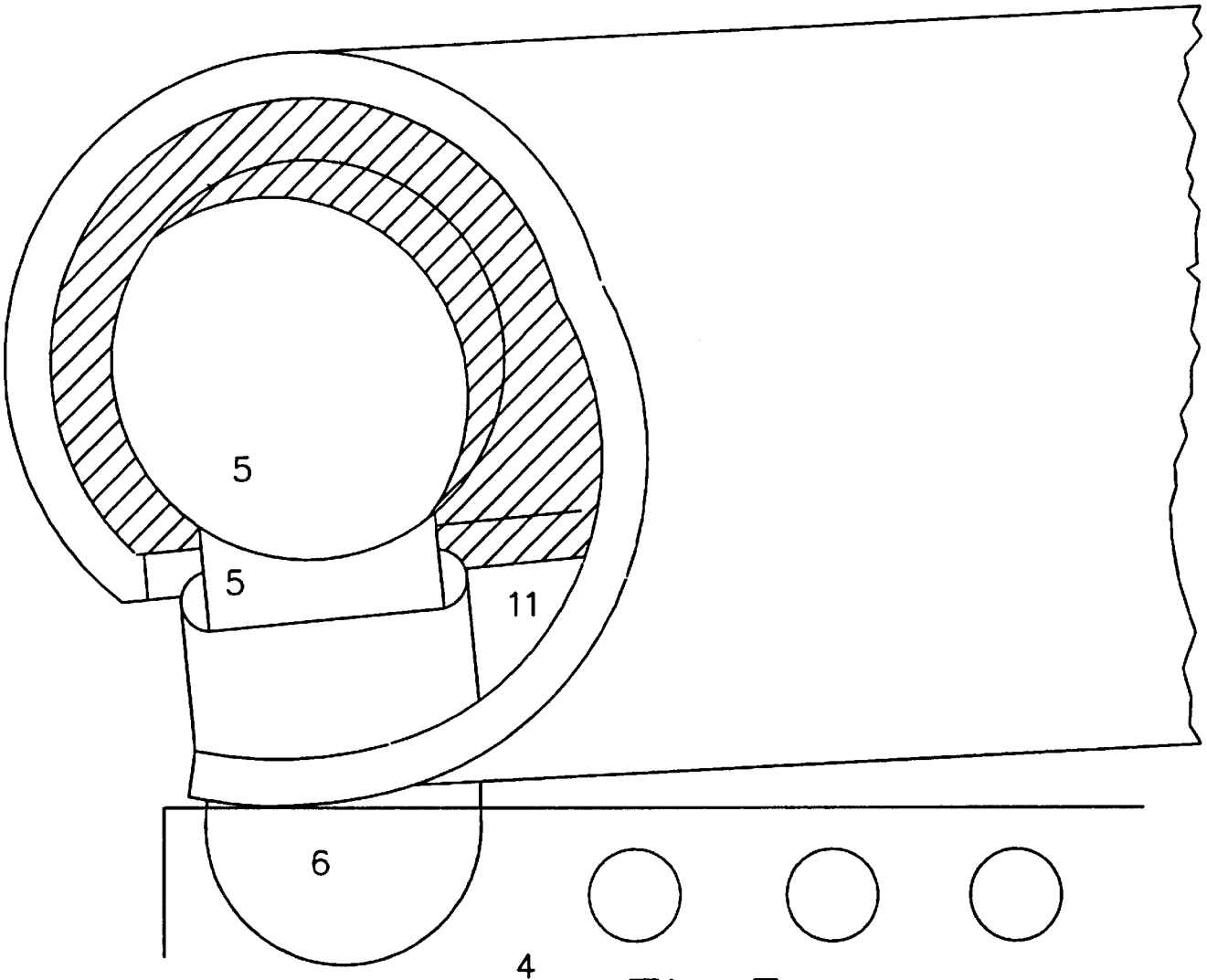
FIG. 3. Exploded side angled view of the Easy Curtain System

In the exploded view in FIG. 3 only one of the bead attachments, 5 is in place with the cosmetic cover, 6 also in place. Note that for the straight track rod, 1 the rod must come down so that the bead attachment devices, 5 can be placed in the rod and slide down the track, 11 till all bead attachment devices are in the track, 11 and the curtain or liner, 4 is completely hung.

Figure 4:
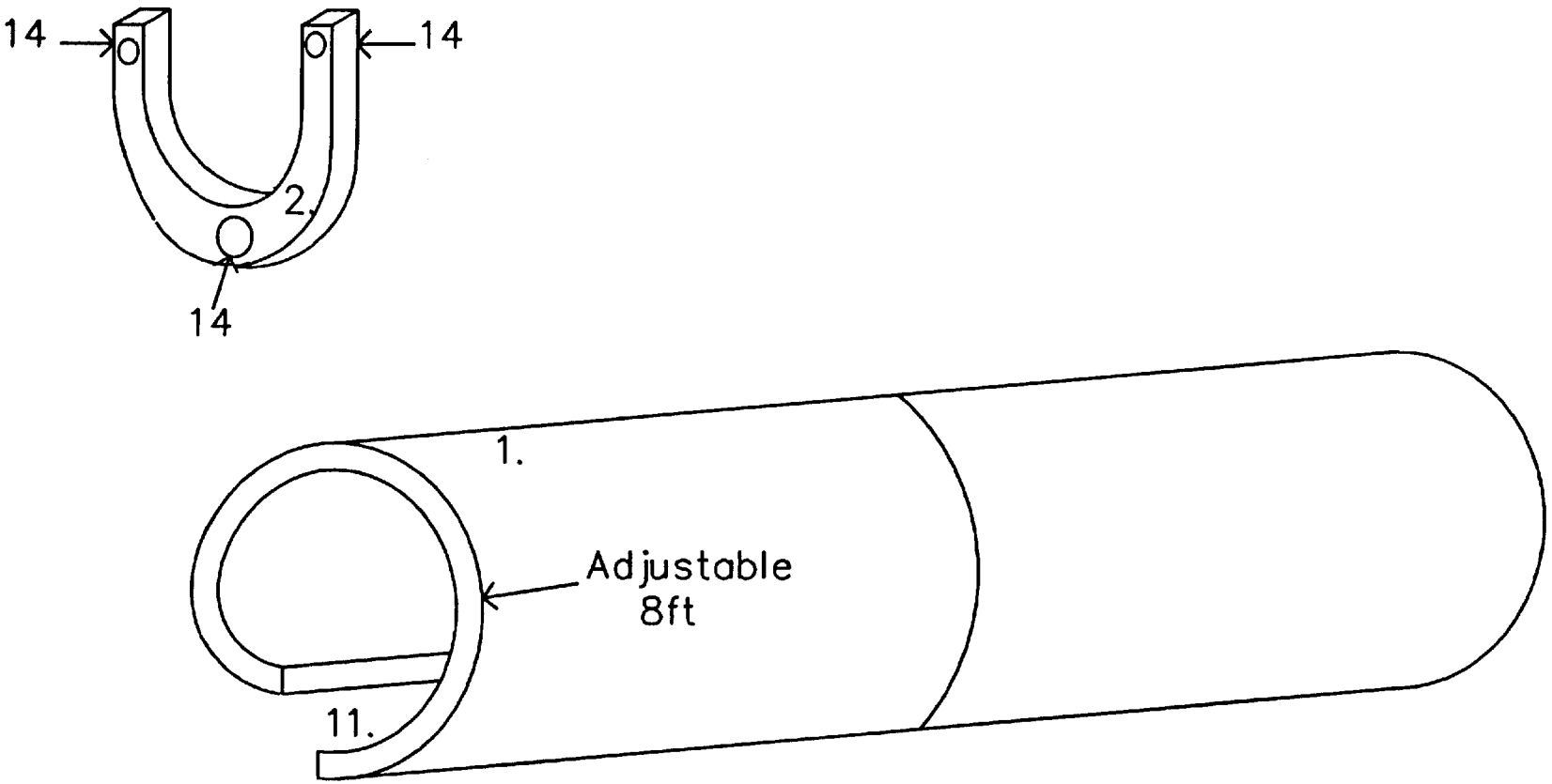
FIG. 4. Front angled view of the adjustable rod with the straight track at the base of the rod and a U-shaped socket rod holder.

In FIG. 4. the adjustable rod, 1 with the straight track, 11 is pictured, and number 15 only indicated the telescoping capability of the rod. The U-shaped socket rod holder, 2, comes with spots, 14 that can be punched out with a little force if the rod holders will be screwed in place. If the desire is to not put holes in the wall of the bath or shower stall, the rod holders, 2, can be put in place with a type of adhesive material.

Figure 5:
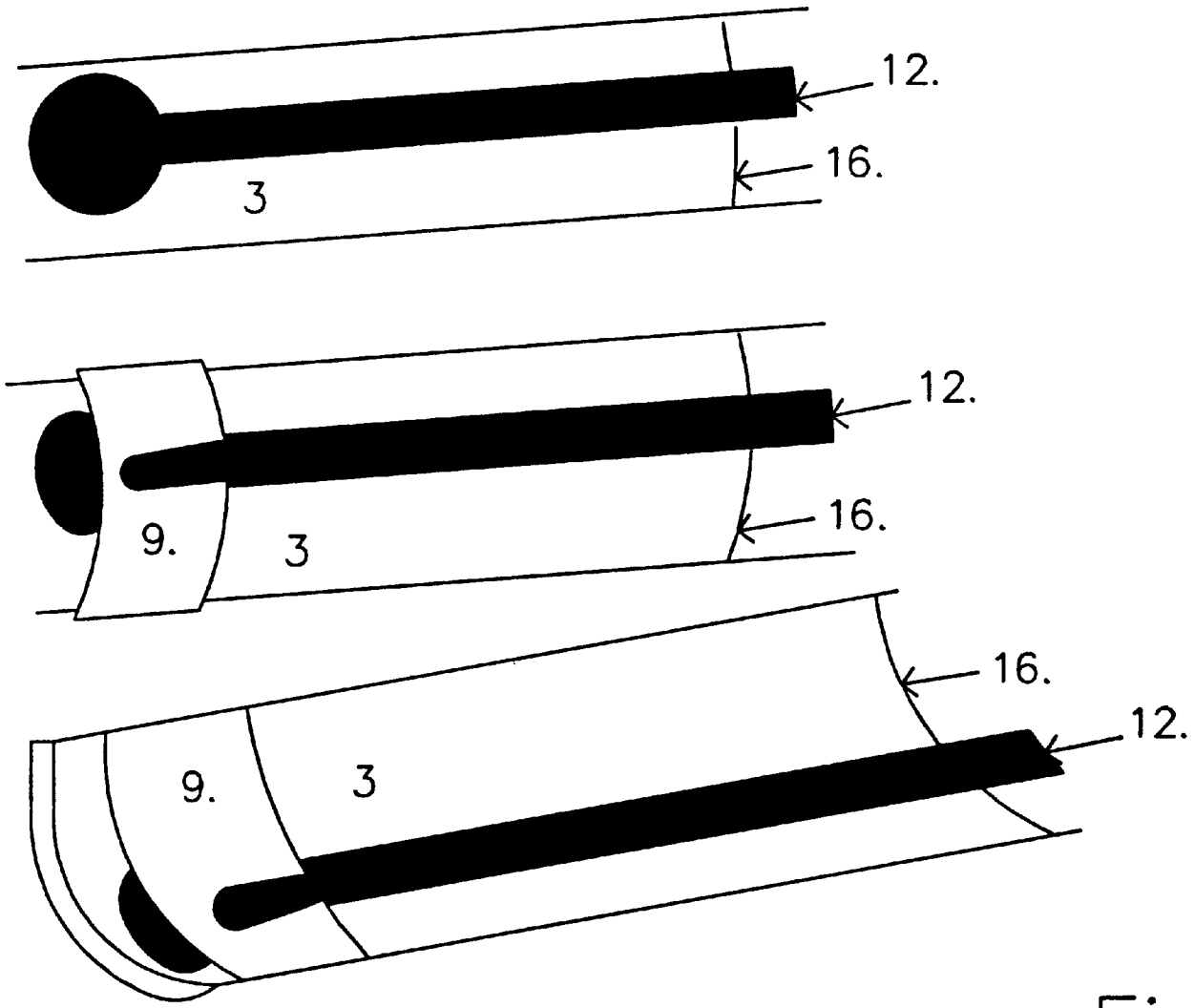
FIG. 5. Two under views and one angled bottom view of the adjustable rod with circular opening near the beginning of the track. On two of the views the clamp is partially covering the circular opening.

In FIG. 5 the track of the adjustable rod, 3 is indicated by number 12. The track has a circular cut-out area for receiving the bead attachment devices for all styles of the bead attachment devices. Number 16 indicates that the rod has telescoping capability to fit all sizes of tub and shower stalls. For rod number 3, unlike rod number 1, the rod doesn't have to come down to attach the bead attachment devices. While the rod is in place and the clamp is up like in FIG. 6, the bead can be fed into the rod, 3. The rod clamp, 9 flips down over the circular cut-out after the beads are in place and the curtain or liner is hung. Once the clamp is closed, the indenture in the rod clamp, 9, enables the beads to be pulled near the end of the rod so that the curtain can enclose all of the stall.

Figure 6:
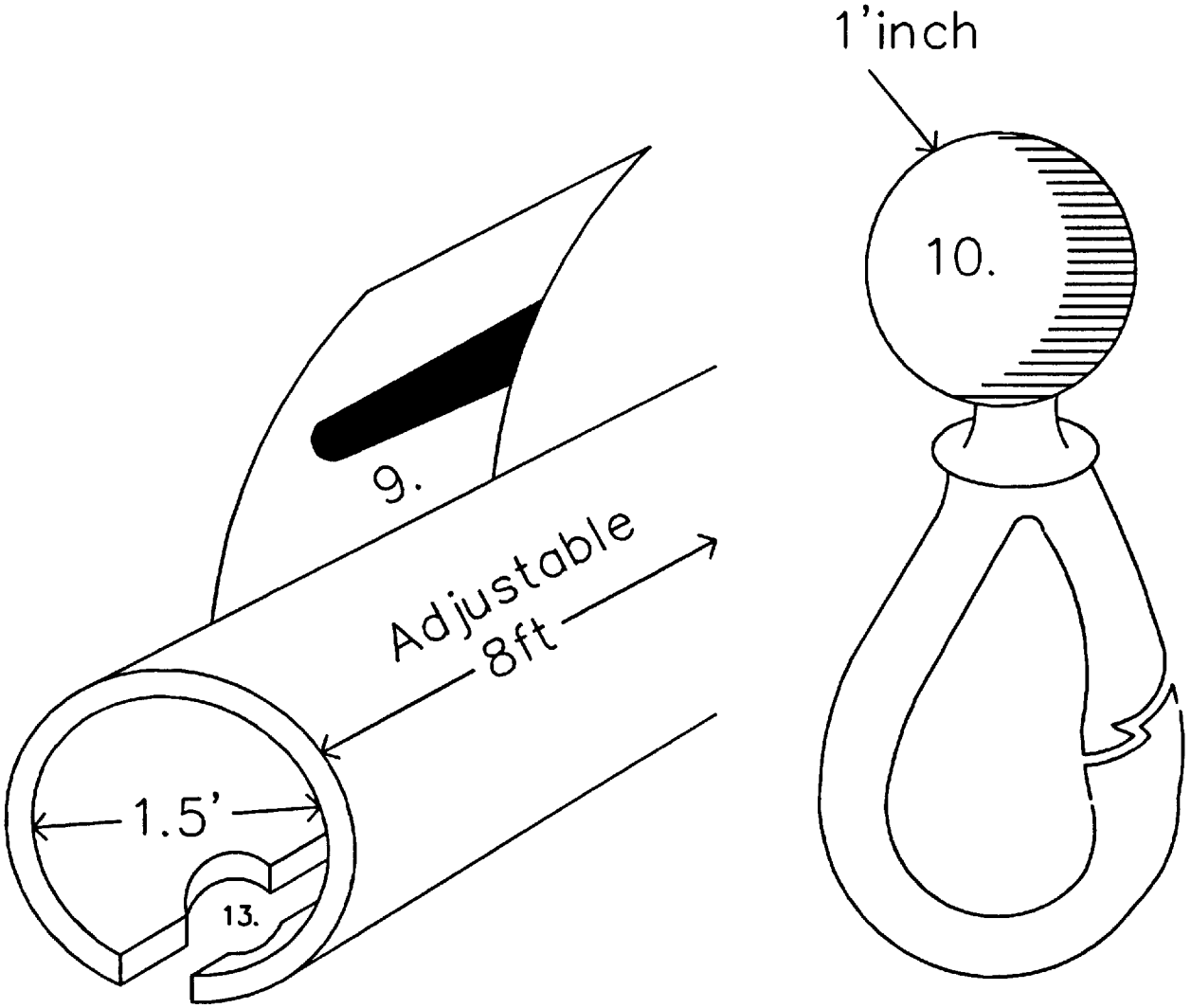
FIG. 6. Side angled front view of the adjustable rod with the circular opening near the beginning of the track at the base of the rod. The rod clamp is raised. The front view of the bead attachment device with squeeze open clamp.

FIG. 6 is a side angled view of the adjustable rod number 3. The clamp, 9 is in the upright position. 13 is the circular cut-out area where the bead is fed into the rod once it is mounted on the wall. A picture of the other type of bead attachment device, 10 is shown. This bead attachment is connected to the standard curtain or liner by squeezing the clamp to open the area where the two contoured ends met.

Figure 7:
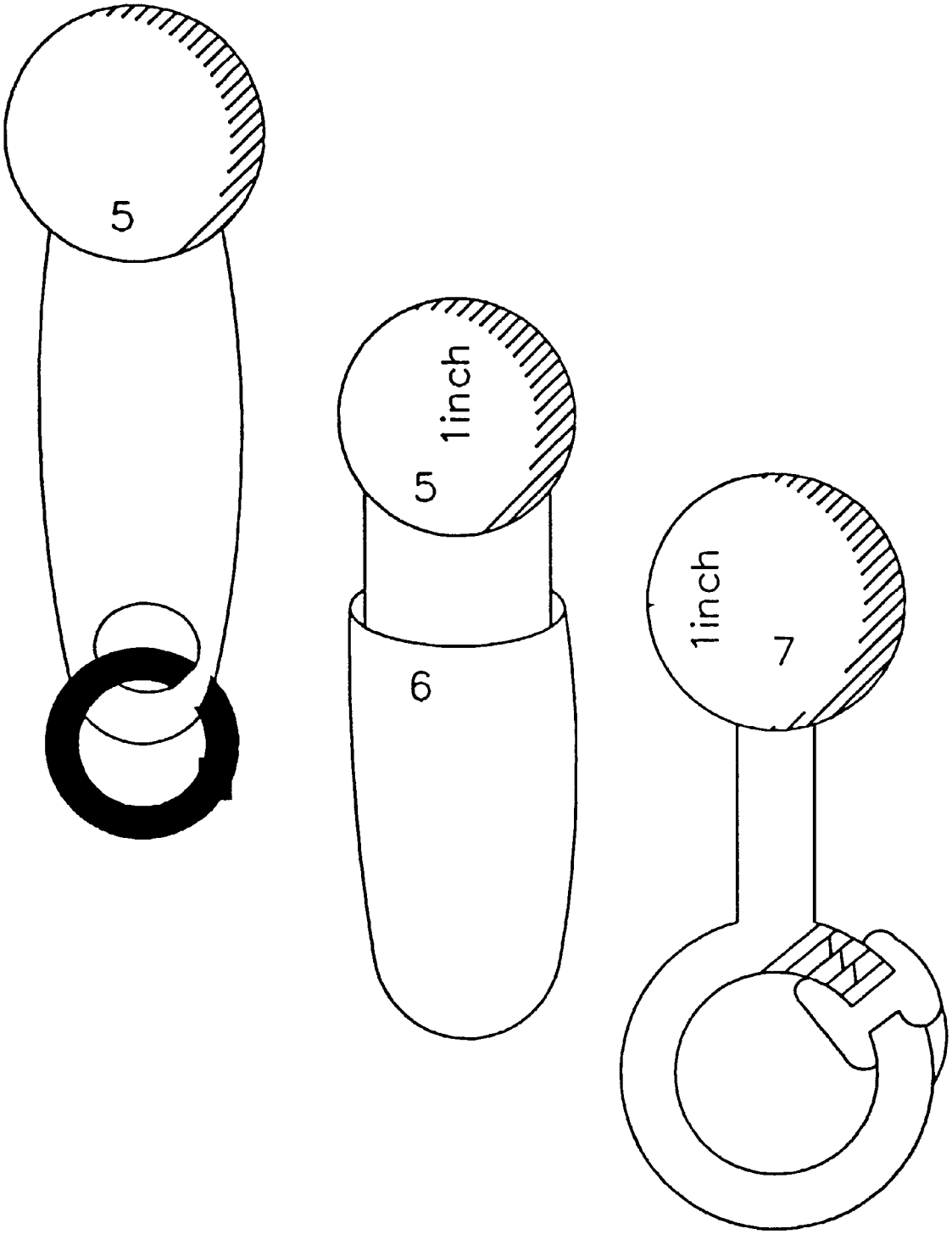
FIG. 7. Front view of the bead attachment with the stretchable ring in place. Front view of the bead attachment with pull back spring open clamp. The middle drawing has the cosmetic cover in place.

In FIG. 7 moving from the upper left side to the lower right side of the drawings, the first bead attachment device, 5, comes with the permanent stretchable ring, 8, connected. The stretchable ring is put part way in the aperture of a standard curtain or liner and then the ring is pulled over the top of the entire bead attachment to loop and connect the device to the curtain or liner. The cosmetic cover, 6 is optional and is more pleasing to the eye. Once the cosmetic cover is slipped onto the bead attachment, 5 only, then the bead attachment is connected to the curtain or liner as stated above. At the lower right of the drawing, the bead attachment, 7 doesn't need the cosmetic cover. The easy pull back spring clamp is easy to handle. When the pull back spring clamp is open, the devices is attached to a standard curtain or liner. When the clamp is released, the spring allows it to snap shut and it is now connected to the curtain or liner. When it is time to wash the curtain, with the water proof spring, these type of bead attachment devices, 7, can remain in place while washing the curtain or liner. Once out of the wash it can be easily replaced on to the rod.

Figure 8:
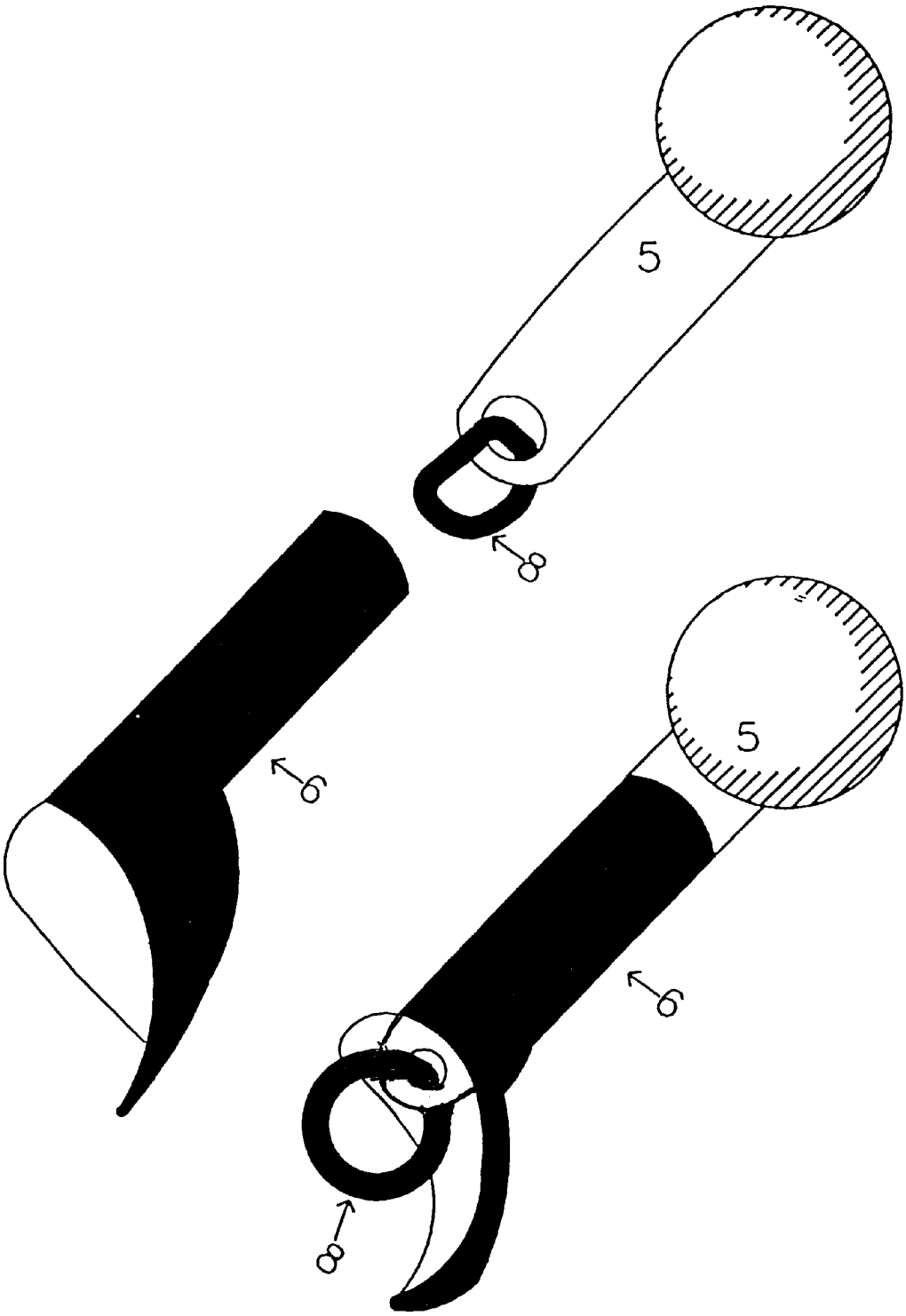
FIG. 8. Side angled view of the bead attachment with the stretchable ring in place. The cosmetic cover is off is one view and in place in the other view.

FIG. 8 shows the bead attachment, 5 with the ring, 8, attached. The cosmetic cover 6, is optional and more pleasing to the eye. The drawing at the lower half of the page shows the bead attachment device, 5 only, with the cosmetic cover, 6 in place. Once the cosmetic cover is in place the ring is placed partly through the aperture of the shower curtain then pulled and looped to connect the curtain and the bead attachment, 5 only.

What is claimed is:

1. A shower curtain and rod assembly comprising:

a telescoping hollow rod including a slot extending substantially along the length of the rod and having an enlarged opening at one end receiving a plurality of bead attachment devices, and a removable clamp for covering the enlarged opening and thereby preventing the removal of said bead attachment devices;

a plurality of U-shaped socket rod holders attachable to a shower wall for supporting the rod;

a flexible shower curtain;

said plurality of bead attachment devices attached along an upper edge of the shower curtain, having spherical ends dimensioned to fit through the enlarged opening of the slot and having a diameter larger than the width of the slot, to thereby be received and held within the rod and slot and support the shower curtain along the length of the upper edge.

2. The assembly of claim 1 wherein said plurality of bead attachment devices include a telescoping spring latch.

3. The assembly of claim 1 wherein said plurality of bead attachment devices include a pivoting spring latch.

4. The assembly of claim 1 wherein said plurality of bead attachment devices include a ring.

* * * * *